US006070609A

United States Patent [19]

Becker

[11] Patent Number: 6,070,609

[45] Date of Patent: Jun. 6, 2000

[54] PLASTER GUARD FOR CONCEALED VALVES

[75] Inventor: Albert Becker, Wittlich, Germany

[73] Assignee: American Standard Inc., Piscataway, N.J.

[21] Appl. No.: 08/612,045

[22] Filed: Mar. 7, 1996

[30] Foreign Application Priority Data

Mar. 27, 1995 [AT] Austria ..... 551/95

[51] Int. Cl.[7] ..... F16K 27/08

[52] U.S. Cl. ..... 137/377; 137/327; 137/360; 251/292

[58] Field of Search ..... 137/327, 360, 137/377, 359; 251/292

[56] References Cited

U.S. PATENT DOCUMENTS

| | | | |
|---|---|---|---|
| 942,541 | 12/1909 | Carlson | 137/327 |
| 5,031,658 | 7/1991 | Brattoh | 137/377 |
| 5,497,584 | 3/1996 | Bergmann | 137/360 |

*Primary Examiner*—A. Michael Chambers

[57] ABSTRACT

A plaster guard for a concealed sanitary valve which can be controlled by means of a valve control element such as a valve spindle or a valve control disc. The plaster guard is equipped with a tool to operate the valve control element.

11 Claims, 2 Drawing Sheets

PLASTER GUARD FOR CONCEALED VALVES

BACKGROUND OF THE INVENTION

The invention is directed to a plaster guard for a concealed sanitary valve which can be controlled by means of a valve control element such as a valve spindle, a valve control disc or the like.

The procedure used to install concealed valves for sanitary fittings involves installing the concealed part of the valve into a wall and covering it with a plaster guard. The wall section into which the concealed part of the valve is fitted is then plastered and, if necessary, a wall decoration (e.g., tile, wallpaper) is applied. The plaster guard protects the valve from dirt and damage during these work stages. The plaster guard is then removed and the fitting is finally assembled. The escutcheon plates, handles and the like are mounted. However, before the final assembly is carried out, the entire installation must be rinsed through to see if it functions properly and is leakproof. It is subjected to general tests including a test for water pressure tolerance. This requires the use of suitable tools, spare handles and the like which may not be readily available and can cause delays.

Thus, it is desirable that a tool for testing valve control elements be designed to be accessible during the installation of sanitary fittings. It is important that the tool be shaped and sized to fit valve control elements. It is preferable that the tool is incorporated into the plaster guard.

SUMMARY OF THE INVENTION

Generally speaking, in accordance with the present invention, a plaster guard equipped with a tool for operating the valve control element of a sanitary fitting is provided. The plaster guard, when removed, is used as a tool to test the valve element for performance. If the test is successful, one can proceed with the final assembly of the sanitary fitting.

It is preferable to incorporate the tool on the side of the plaster guard not facing the valve such that when the plaster guard is removed, it can be turned around and used as a tool. More specifically, if the valve control element is a hollow spindle with internal grooving, the tool is designed with external grooving which fits into the grooves on the hollow spindle so that the hollow spindle can be turned by means of the plaster guard and the tool. If the valve control element is a valve disc which can be moved with a control lever which is square-shaped at the end, the tool is designed with a square recess into which the end of the lever fits. In this way the valve disc can be turned and moved by means of the plaster guard.

The tool can either be integrated with the plaster guard as one piece or formed as a separate part solidly bonded with the plaster guard so that the separate part and the plaster guard can be handled as one unit and the movement of the plaster guard can be transmitted directly to the valve control element by means of the tool. The plaster guard can be equipped with several different types of tools so that they can be used for different concealed valves. It is preferable that different types of tools are formed on the same tool shank.

BRIEF DESCRIPTION OF THE DRAWINGS

The invention will be more fully appreciated from the following detailed description when the same is considered in connection with the accompanying drawings in which.

DETAILED DESCRIPTION OF THE INVENTION

Figure 1:
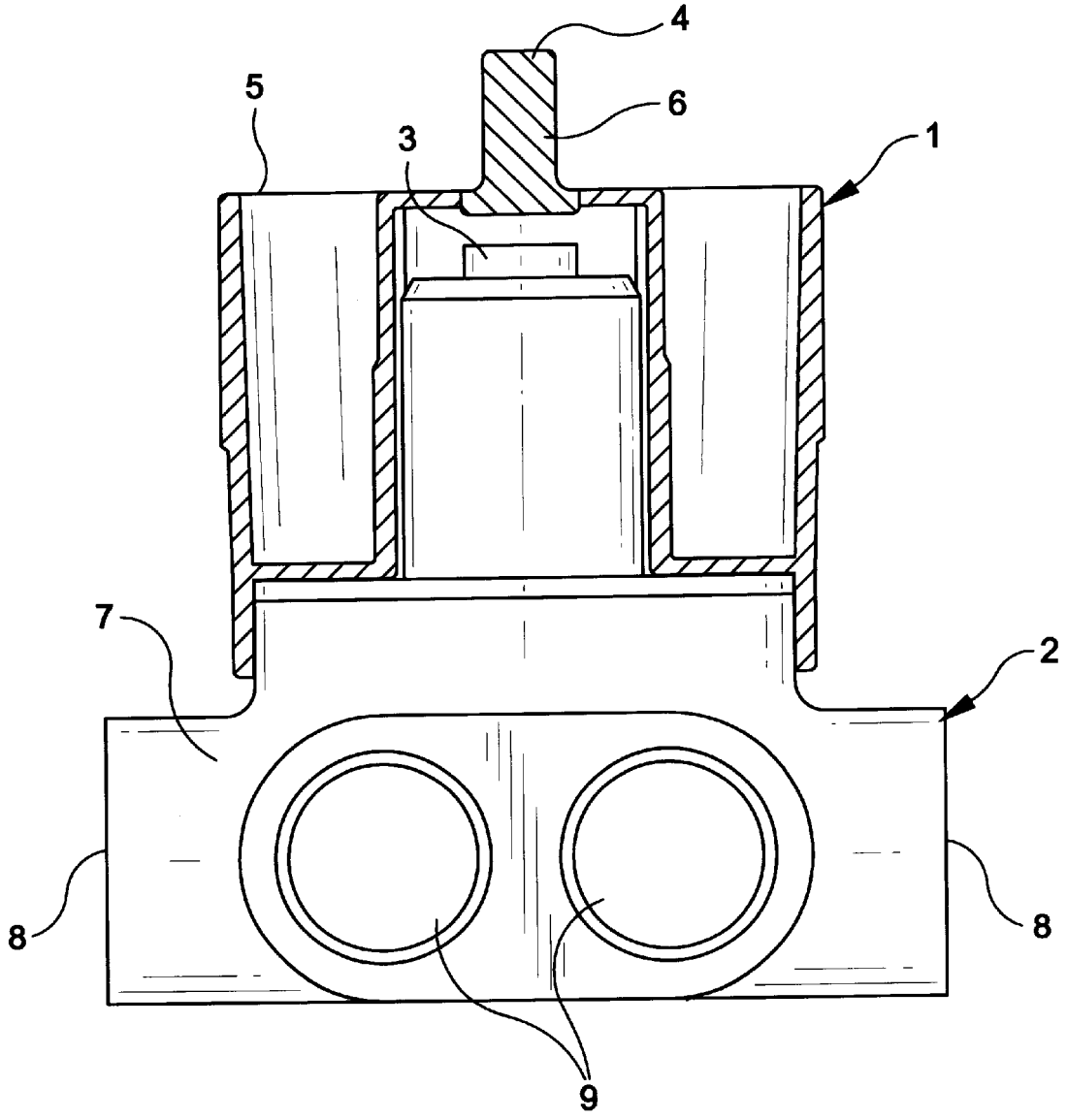
FIG. 1 is a top plan view of the valve with the plaster guard thereon in accordance with the claimed invention.
Figure 2:
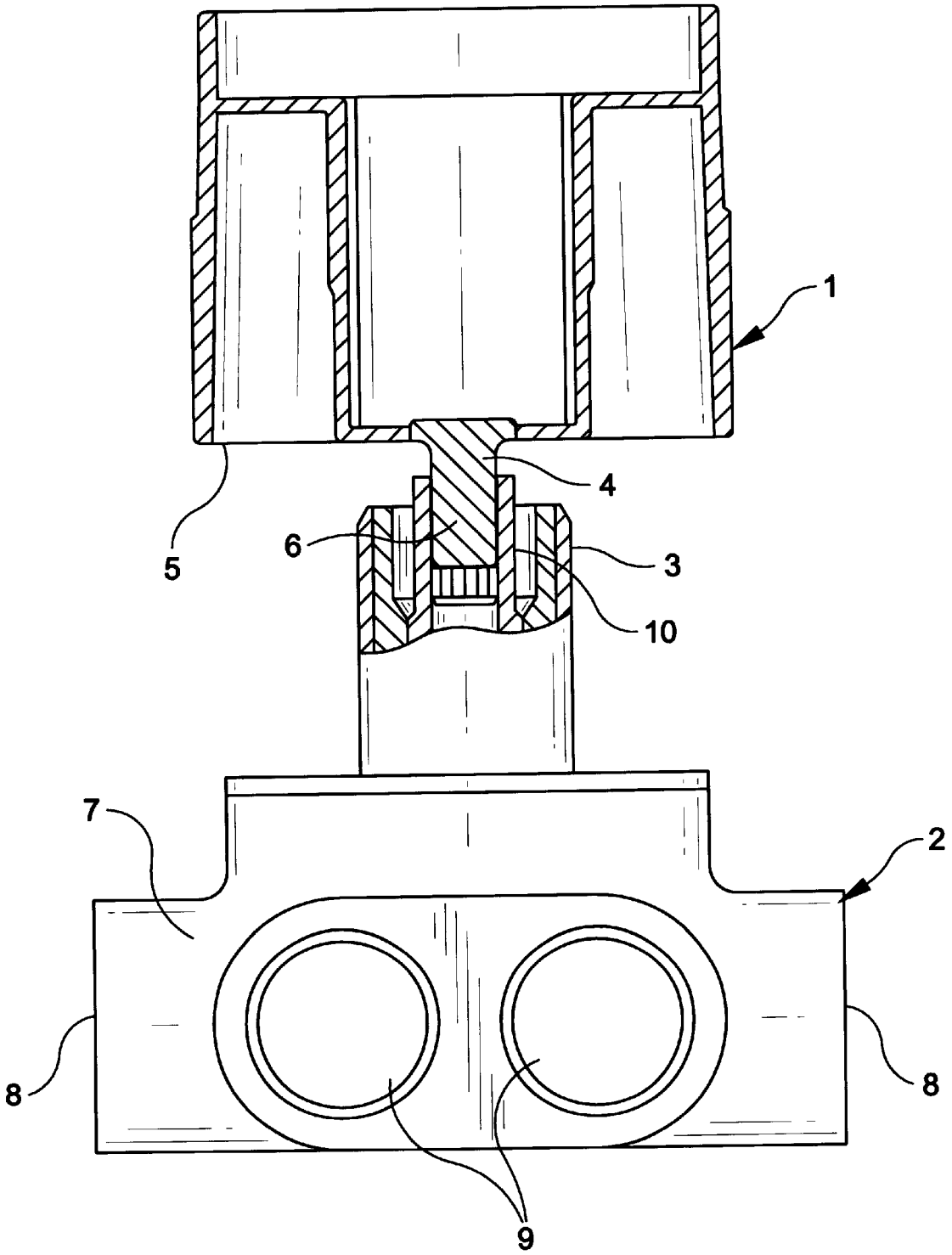
FIG. 2 is a top plan view of the valve with the plaster guard applied to the valve as a tool.

Reference is now made to FIGS. 1 and 2 which depict a plaster guard 1 and a multi-way valve 2. Valve 2 has a conceal ed valve body 7 having water inlet openings 8 and water outlet openings 9. Valve 2 is controlled by means of a valve spindle 3 which is formed as a hollow spindle. It should be mentioned that the control means is not hereto limited to a spindle and may be any suitable control means. Plaster guard 1, includes a protection cover section or side which in its function as a protection cover, acts as a shield against dirt for that part of multi-way valve 2 which projects from the brickwork.

As can be seen in the drawing figures, plaster guard 1 includes a tool bearing section or side which bears a tool 4 to the side 5 not facing valve 2. Tool 4 and plaster guard 1 are constructed as one piece. Once the wall, into which valve 2 is fitted, is plastered and provided with the appropriate decoration as the case may be, e.g. tile, plaster guard 1 is removed from valve 2. Plaster guard 1 is rotated and tool 4 is used to open valve 2. The installation is then tested to determine whether it is leakproof and functions correctly. It is also checked for its tolerance to water pressure. Tool 4 has a tool shank 6 to which is coupled a cylindrical section 10 which is characterized by external grooving. Tool 4 can be applied to hollow spindle 3 of valve control element 2 by matching the corresponding grooving in the inside of hollow spindle 3 to that in the tool. By rotating plaster guard 1, a torque is transmitted to spindle 3 through tool 4, thus allowing all flow possibilities through valve 2 to be tested.

The plaster guard of the present invention is multifunctional. It provides protection against damage and prevents dirt from entering the valve. It also acts as a tool for testing the performance of the valve. The plaster guard can be used for other types of valves and is not limited to the valve shown. It can also be used for concealed single-lever mixing valves, whereby a torque can be transmitted to the valve control disc through the plaster guard and tool. The plaster guard can be designed with a tool section having a configuration which corresponds to the shape of the valve end. In this way, if the control lever, which acts on and directs the valve control disc, has a square end onto which the operating handle can be applied later, the tool provided on the plaster guard must have a corresponding square recess to accommodate this configuration.

Although illustrative embodiments of the present invention have been described herein with reference to the accompanying drawings, it is to be understood that the invention is not limited to those precise embodiments, and that various other changes and modifications may be effected herein by one skilled in the art without departing from the scope or spirit of the invention.

What is claimed is:

1. A plaster guard for use with a valve which includes a valve control element, said plaster guard comprising:

an inner surface defining an open-ended recess which is adapted to fit over at least part of the exterior of the sanitary valve; and an outer surface which includes a tool portion for engaging the valve control element.

2. The plaster guard according to claim 1 wherein said control element is an element selected from the group consisting of a valve spindle and a valve control disc.

3. The plaster guard according to claim 1 wherein said tool portion is disposed opposite said open-ended recess.

4. The plaster guard according to claim 1 wherein said tool portion comprises external grooving and said spindle comprises corresponding internal grooving, wherein said external grooving is capable of being inserted into said internal grooving.

5. The plaster guard according to claim 1 wherein said valve control element includes a square-shaped end and said tool portion is provided with a square recess which is capable of mating with said square-shaped end.

6. The plaster guard according to claim 1 wherein said tool portion is formed with the remainder of said plaster guard in a one-piece construction.

7. The plaster guard according to claim 1 wherein said tool portion is formed as a separate component which is solidly bonded to the remainder of said plaster guard.

8. The plaster guard according to claim 1 wherein said tool portion comprises a plurality of tools.

9. The plaster guard according to claim 8 wherein said tool portion further comprises a single tool shank upon which said plurality of tools are disposed.

10. The plaster guard according to claim 1 wherein said open-ended recess is formed to mate with the exterior shape of the valve.

11. The plaster guard according to claim 1 further comprising a skirt portion which at least partially defines said open-ended recess.

* * * * *